US011404773B1

(12) United States Patent
Aga et al.

(10) Patent No.: US 11,404,773 B1
(45) Date of Patent: Aug. 2, 2022

(54) ADDITIVELY-MANUFACTURED OMNIDIRECTIONAL ANTENNA

(71) Applicant: Government of the United States, as represented by the Secretary of the Air Force, Wright-Patterson AFB, OH (US)

(72) Inventors: Roberto S. Aga, Beavercreek, OH (US); Emily M. Heckman, Dayton, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 17/344,101

(22) Filed: Jun. 10, 2021

(51) Int. Cl.
*H01Q 1/42* (2006.01)
*H01Q 21/20* (2006.01)

(52) U.S. Cl.
CPC ..... *H01Q 1/422* (2013.01); *H01Q 21/205* (2013.01)

(58) Field of Classification Search
CPC ..... H01Q 1/422; H01Q 21/205
See application file for complete search history.

(56) References Cited

U.S. PATENT DOCUMENTS 2,629,051 A * 2/1953 Lindenblad ..... H01Q 1/286 333/24 R
2005/0184920 A1* 8/2005 Mahler ..... H01P 5/10 343/772
2020/0393274 A1* 12/2020 Dardona ..... G01M 5/0083

OTHER PUBLICATIONS

Sun, L., et al., Low-Profile Omnidirectional Antenna with Dual Polarizations for 2.4GHz WLAN Applications, Progress in Electromagnetics Research Letters, vol. 65, 89-94, 2017.
Panda, J.R. et al., A Printed 2.4 GHZ/5.8GHZ Dual-Band Monopole Antenna With a Protruding Stub in the Ground Pl.ane for WLAN and RFID Applications, Progress in Electromagnetics Research, vol. 117, 425-434, 2011.

(Continued)

*Primary Examiner* — Dimary S Lopez Cruz
*Assistant Examiner* — Jesus E Cano
(74) *Attorney, Agent, or Firm* — AFMCLO/JAZ; Timothy M. Barlow

(57) ABSTRACT

A method for making an antenna comprises creating a digital antenna file defining dimensional characteristics of a radiating support structure and a ground support structure; uploading the digital antenna file to an additive-manufacturing device; manufacturing the radiating support structure and ground support structure with the additive-manufacturing device; coating one side of the radiating support structure and ground support structure with a conductive ink; attaching the radiating support structure and ground support structure together; fixing a radio frequency connector to the conductive ink on the radiating support structure and the ground support structure. The radiating support structure and the ground support structure are attached together with a dielectric adhesive. The radio frequency connector is a coaxial cable; its center conductor is connected to the conductive coating of the radiating support structure and its outer conductor is connected to the conductive coating of the ground support structure using a conductive adhesive.

4 Claims, 6 Drawing Sheets

(56) References Cited

OTHER PUBLICATIONS

Liang, M., et al., Three-Dimensionally Printed/Additive Manufactured Antennas, DOI: 10.1007/978-981-4560-44-3_109 in book: Handbook of Antenna Technologies (pp. 661-697), Sep. 2016.
Kiesel, G., et al., Practical 3D Printing of Antennas and RF Electronics, Jun. 2020.
Wong, K.L., et al., A Low-Profile Omnidirectional Circularly Polarized Antenna for WLAN Access Point, 2004, IEEE 2580-2583.
Cathey, C. et al., Additive Manufacturing Yields Optimized Antennas, https://cdn.baseplatform.io/files/base/ebm/mwrf/document/2019/03/mwrf_7165_new_30q.pdf, Oct. 2017.
Cohen, Z., The Advantages of Designing a Nonplanar Antenna With Additive Manufacturing, 2019.
Mitchell, G., et al., Additive Manufacturing for Antenna Applications, DOI: http://dx.doi.org/10.5772/intechopen.92363, May 2020.

* cited by examiner

ADDITIVELY-MANUFACTURED OMNIDIRECTIONAL ANTENNA

RIGHTS OF THE GOVERNMENT

The invention described herein may be manufactured and used by or for the Government of the United States for all governmental purposes without the payment of any royalty.

FIELD OF THE INVENTION

The present invention relates generally to omnidirectional antennas and, more particularly, to an additively-manufactured omnidirectional antenna.

BACKGROUND OF THE INVENTION

The state-of-the-art omnidirectional antenna is fabricated by a non-additive approach. Conventional methods for making antennas may include the use of printed circuit boards (PCBs) such as FR4, photolithography, wet etching, metallization and soldering. The manufacturing process typically involves cutting and etching a printed circuit board (PCB) into a circular disk, machining a dielectric foam, and cutting and soldering copper foils. For a complicated antenna structure, putting together the parts can be tedious and prone to error. Thus, it may require long touch time, which increases the labor cost. What is desired is a new approach that takes advantage of additive manufacturing technology, and which can make complicated antenna structures rapidly and cost-effectively.

SUMMARY OF THE INVENTION

The present invention overcomes the foregoing problems and other shortcomings, drawbacks, and challenges of antenna manufacturing. While the invention will be described in connection with certain embodiments, it will be understood that the invention is not limited to these embodiments. To the contrary, this invention includes all alternatives, modifications, and equivalents as may be included within the spirit and scope of the present invention.

The invention provides an alternative method to fabricate omnidirectional antennas that is significantly faster and more cost-effective than conventional antenna fabrication methods. The method offers an antenna design that may be fabricated quickly by additive techniques, and the material cost is significantly lower than conventional methods. Instead of using planar PCBs as substrate material, the invention uses 3D-printed material as the substrate. Thus, antenna design is not limited to planar geometry.

The term 'about' indicates a stated time+/−10 minutes, and a temperature+/−10° C.

According to one embodiment of the present invention a method for making an antenna comprises creating a digital antenna file defining dimensional characteristics of a radiating support structure element and a ground support structure disk; uploading the digital antenna file to an additive-manufacturing device; manufacturing the radiating support structure element and ground support structure disk with the additive-manufacturing device; coating one side of the radiating support structure element and ground support structure disk with a conductive ink; attaching the radiating support structure element and ground support structure disk together; fixing a radio frequency connector to the conductive ink on the radiating support structure element and the ground support structure disk.

The dimensional characteristics of the radiating support structure and ground support structure correspond to the operating frequency of the antenna.

The radiating support structure element and the ground support structure disk may be attached together with a dielectric adhesive.

The radio frequency connector may be a coaxial cable where its center conductor is fixed connected to the conductive ink coating of the radiating support structure element and its outer conductor is connected to the conductive coating of the ground support structure plane with using a conductive adhesive. In the alternative, the coaxial cable may be omitted so that the antenna is able to be connected directly to a transmission frequency source or frequency reception apparatus.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The invention provides a design and method to rapidly manufacture a low-cost omnidirectional antenna by additive technique. The design consists of two additively-manufactured components fixed together, e.g. glued, with the RF cable or connector. The components become an integral unit. The components are first 3D printed from a thermoplastic source material using a fused deposition modeling (FDM) printer. This is followed by a polishing process to reduce the surface roughness. One component is coated with the radiating element while the other is coated with the ground plane. The electrically-conductive coating may be printed with NSCRYPT using a commercial silver ink 15. An antenna operating at 2.4 GHz is demonstrated herein. This omnidirectional antenna is appropriate for data link applications, for example.

Figure 1:
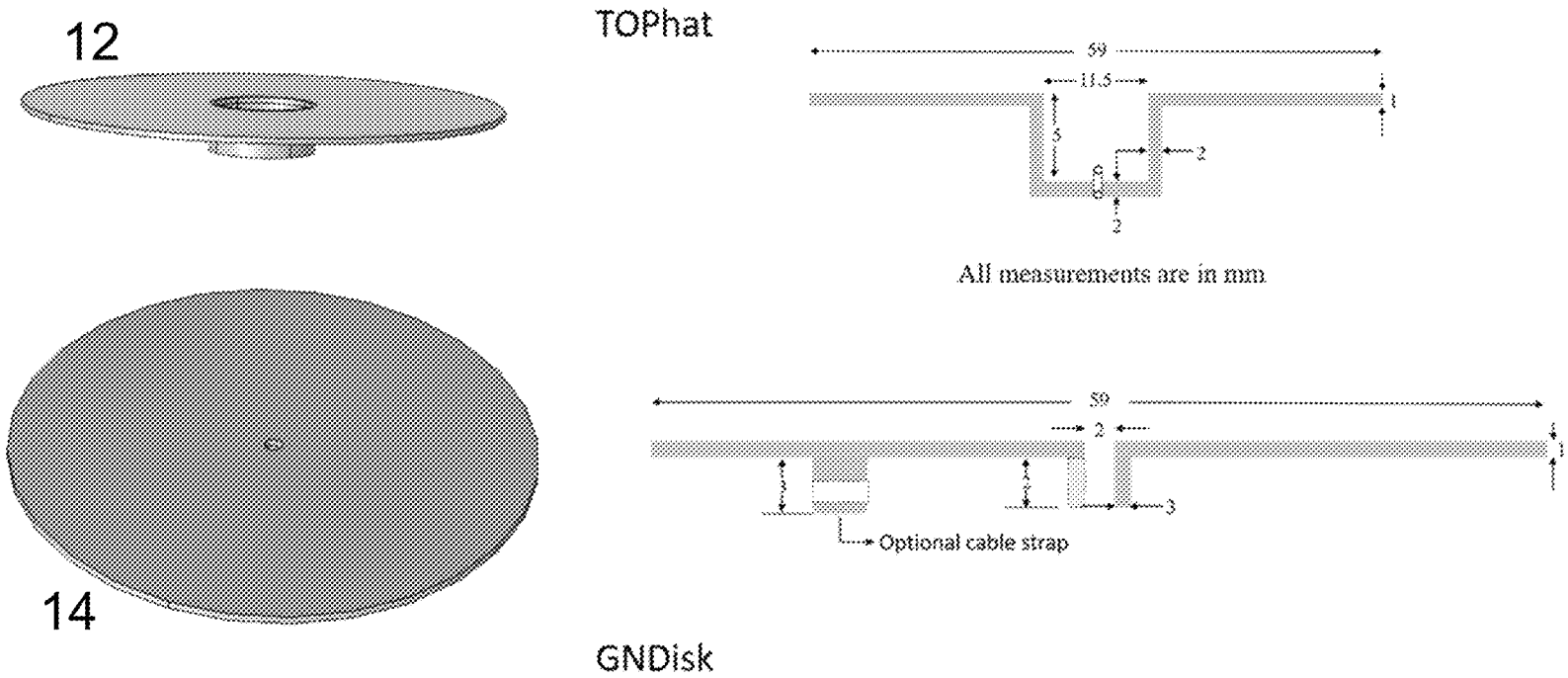
FIG. 1 presents perspective and sectional view of a radiating support structure and ground support structure for an antenna according to an embodiment of the invention.

The antenna design is comprised of two main parts. For convenience, these parts are labeled as TOPhat 12 (the radiating support structure) and GNDisk 14 (the ground support structure). FIG. 1 presents an exemplary model view of each part and their corresponding cross-sectional side view with dimensions suitable for a 2.4 GHz antenna.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

This invention takes advantage of additive manufacturing technology to simplify the process, reduce touch time, and lower the cost of the antenna. With an additive approach, the antenna design is simplified into two parts, i.e. radiating support structure 12 and ground support structure 14, that are bonded together easily. The electrically-conductive coating for the radiating support structure 12 and the ground support structure 14 is also straight forward to apply with a direct printing technique. Rapid fabrication permits users to make custom replacements quickly and cheaply. The ability to quickly replenish components in the field at a lower cost is important for everyone.

Method

The first step is to define the antenna's form and size, which should be appropriate for the antenna's intended use and operating frequency. Next, a 3D model of the antenna design is created and saved. This may be done using commercial CAD packages such as Solidworks, AutoCAD, and the like. A typical antenna design may consist of two 3D-printed non-electrically conducting parts, e.g. radiating support structure 12 and ground support structure 14, which are glued together in a later step. For convenience, the two parts are labeled as TOPhat 12 and GNDisk 14 in the figures. The operating frequency of the antenna depends on the dimensions of the two parts, and can be easily tuned due to the rapid-prototyping feature of additive manufacturing tools. The dimensions for operation at 2.4 GHz, which is a widely used frequency for data link application, are shown in FIG. 1.

Figure 2:
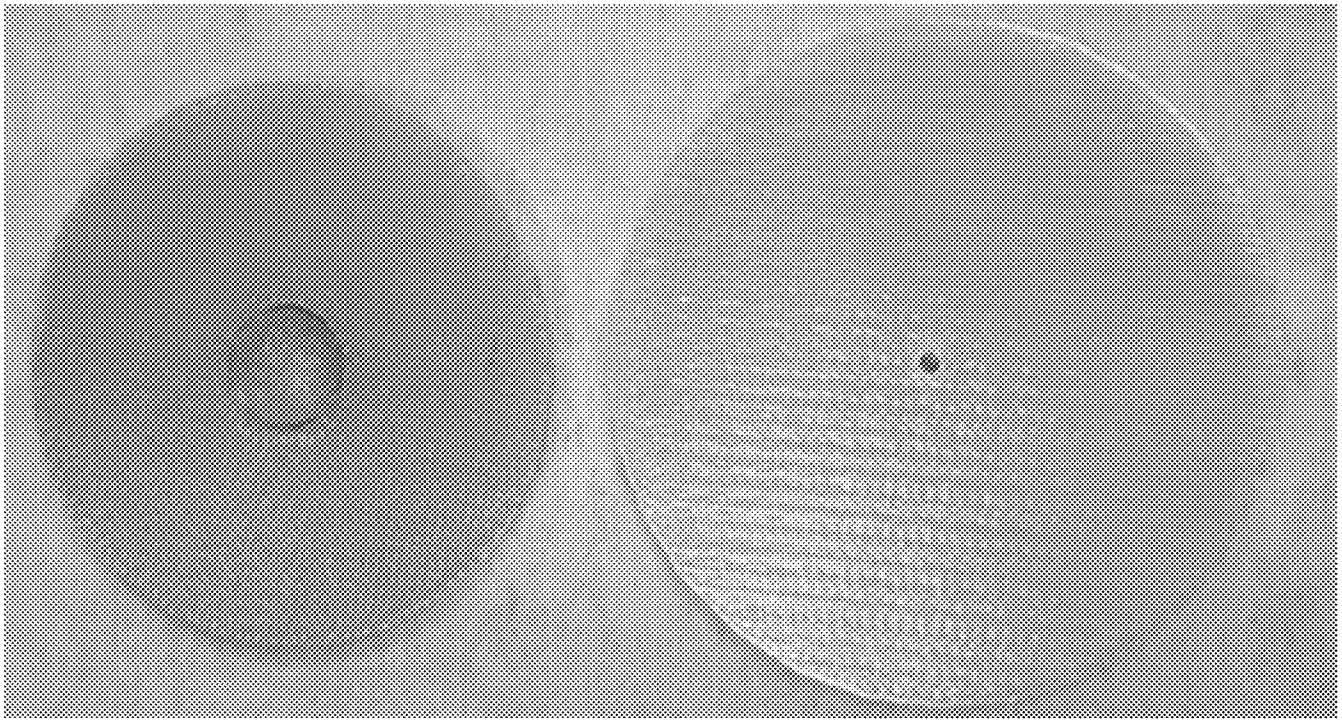
FIG. 2 presents top views of an additively-manufactured radiating support structure and ground support structure for an antenna according to an embodiment of the invention.

The 3D model file is uploaded into a 3D printer for additive manufacturing. Examples of such printers are Fortus FDM (Fused Deposition Modeling) and Formlabs SLA (Stereo Lithography Apparatus) printers or the like. Non-electrically conducting materials that may be used to build the two parts may be thermoplastics and other polymeric-based plastics. FIG. 2 presents the 3D-printed TOPhat 12 and GNDisk 14 which were 3D printed using two different materials.

The surfaces of the 3D printed parts may be polished to reduce surface roughness. Polishing may be accomplished by commercial surface finishers such as LEVO from Post-Process or by hand polishing. This polishing step is optional and may not be needed for some printers and materials.

Next, the front side of the TOPhat and the GNDisk are coated with an electrically-conducting material. This may be done by additive techniques, such as microdispense and aerosol-jet, or non-additive techniques, such as spray painting and hand-coating.

Figure 3:
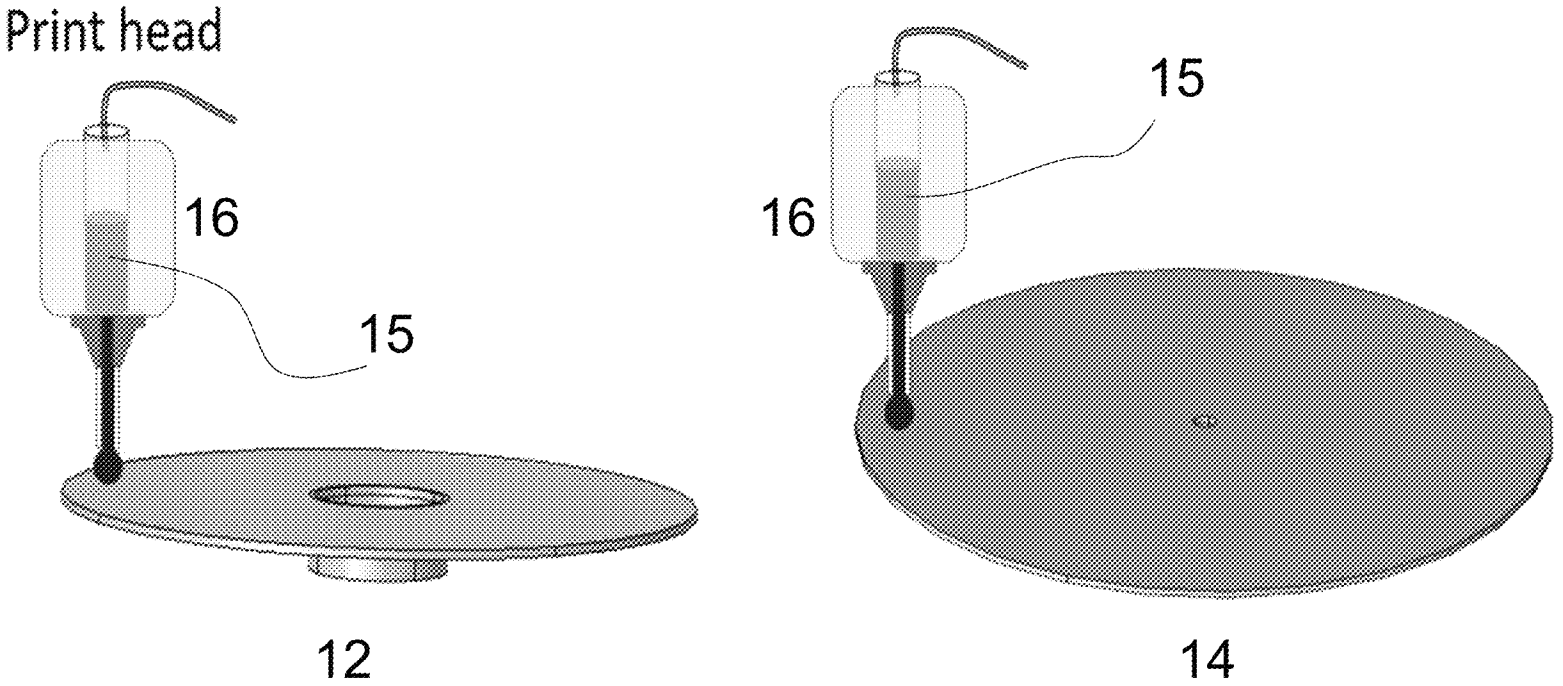
FIG. 3 illustrates the application of a conductive ink on a radiating support structure and ground support structure for an antenna according to an embodiment of the invention.

FIG. 3 presents the coating process using a commercial microdispense printer 16, such as that available from NSCRYPT. The advantage of using additive techniques for coating the electrically-conducting material is the precise placement of the material in the desired locations. This minimizes material consumption and waste, and thus reduces the production cost of the antenna. The conducting material should have high electrical conductivity, comparable to the conductivity of bulk metals such as gold, silver, and copper. In addition, the material should be printable and adhere well on the 3D-printed TOPhat 12 and GNDisk 14. Materials meeting those specifications are available from Dupont and other vendors.

A post-print sintering step may be required for some printable conducting inks 15 to improve their conductivity. For the Dupont ink, sintering may be performed inside a box oven at about 160° C. for about 1 hour.

The coaxial connector that will be used by the antenna to connect to instrumentation needs to be prepared. The connector should be compatible with the operating frequency of the antenna (e.g. 2.4 GHz), and should have the appropriate termination at one end for quick connect/disconnect to the instrumentation. An example of such a connector is an RG 178 cable terminated by MMCX plug. The other end, i.e. antenna end, of the coaxial connector is stripped to expose a short segment of the center conductor and the outer conductor of the RG 178 cable. These exposed segments will be used to provide electrical connection to the antenna. Other connector options to connect the antenna to the instrumentation are available. One option is to use an SMA surface mount connector glued on the back of GNDisk without coaxial cable.

Figure 4:
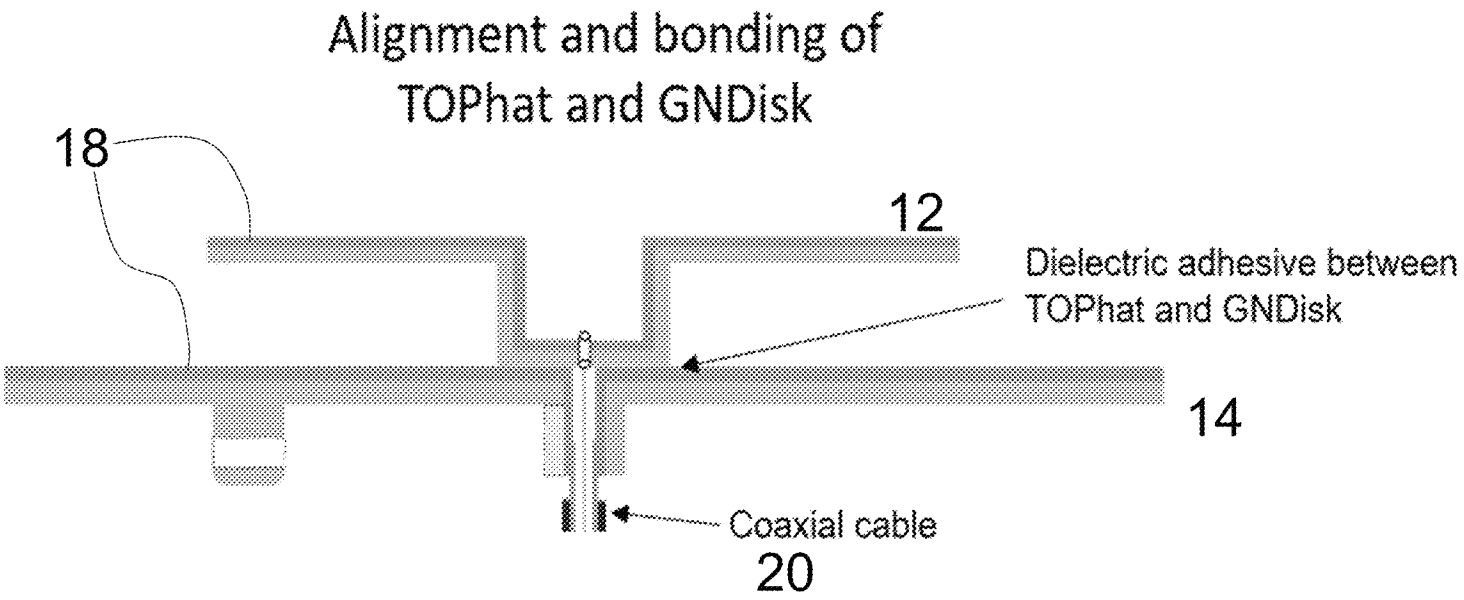
FIG. 4 presents a sectional view of an antenna according to an embodiment of the invention.

The TOPhat 12 and the GNDisk 14 are aligned along the cylindrical axis, i.e. in a concentric manner as depicted in FIG. 4, and bonded together with a coaxial connector 20, as shown in FIG. 4. Any dielectric adhesive with a low loss-tangent at the operating frequency (2.4 GHz) may be used to glue the parts and the coaxial connector together. An example of such adhesive is a 2-part thermally-cured epoxy from Epo-Tek. The exposed center conductor of the coaxial cable 20 is electrically attached to the conducting coating 18 of the TOPhat 12. Similarly, the exposed outer conductor of the coaxial cable 20 is electrically attached to the conducting coating 18 of the GNDisk 14. Electrical attachment may be made with any thermally-cured conducting epoxy, such as a silver-based conducting epoxy. Silver-based conducting epoxies may require sintering inside a box oven at temperature of at least 120° C. for about 30 minutes. Low-temperature soldering is another option for electrical attachment.

Finally, the performance of the completed antenna 10 (FIG. 5A) is tested. The first test may be to determine the operating frequency. This is traditionally accomplished by connecting the antenna 10 to a network analyzer and measuring S11 as a function of frequency. A plot of S11 versus frequency of the completed antenna is presented in FIG. 5B. In the plot, the frequency corresponding to the center of the dip represents the operating frequency of the antenna.

Figure 5A:
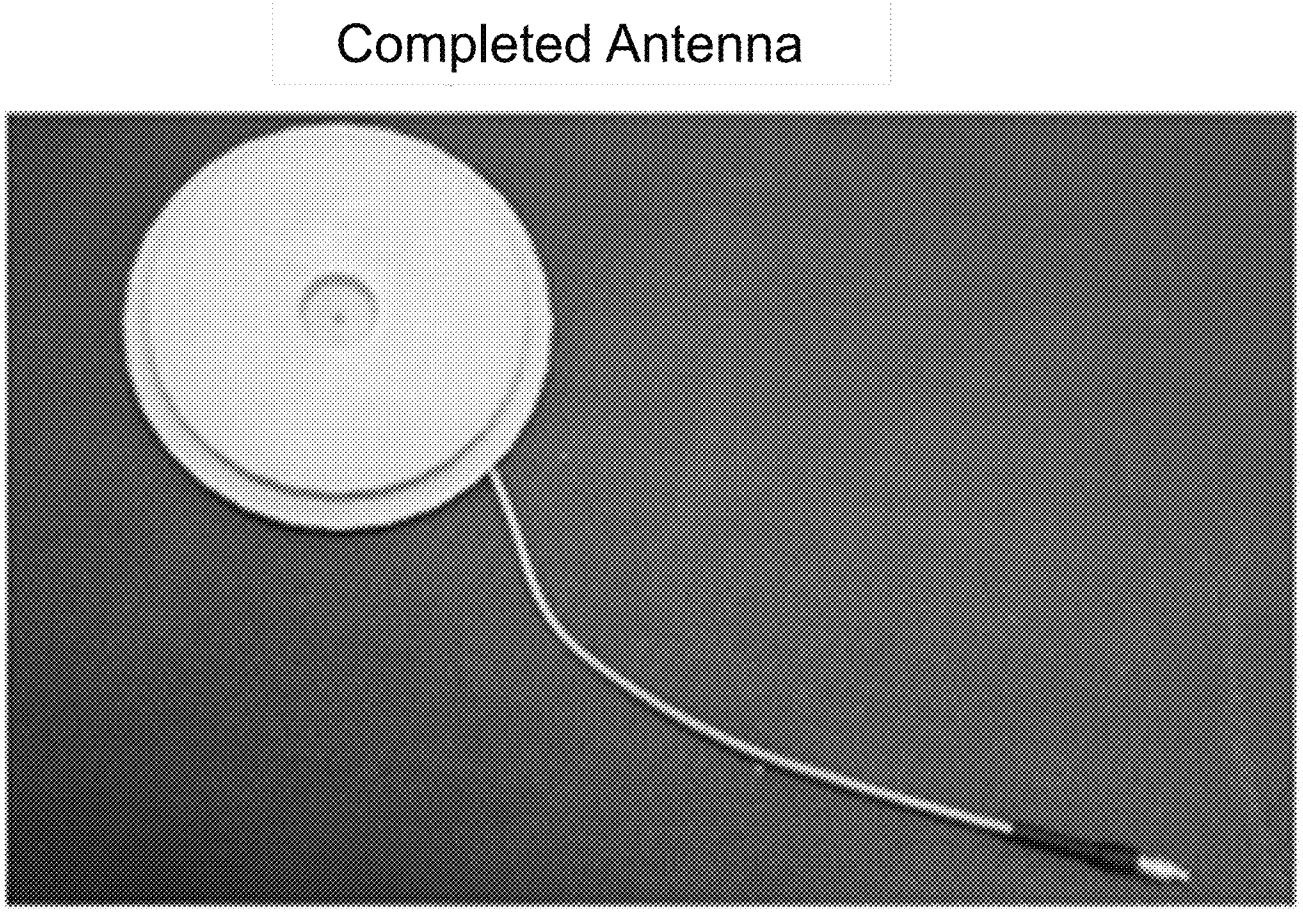
FIG. 5A depicts a finished antenna according to an embodiment of the invention.
Figure 5B:
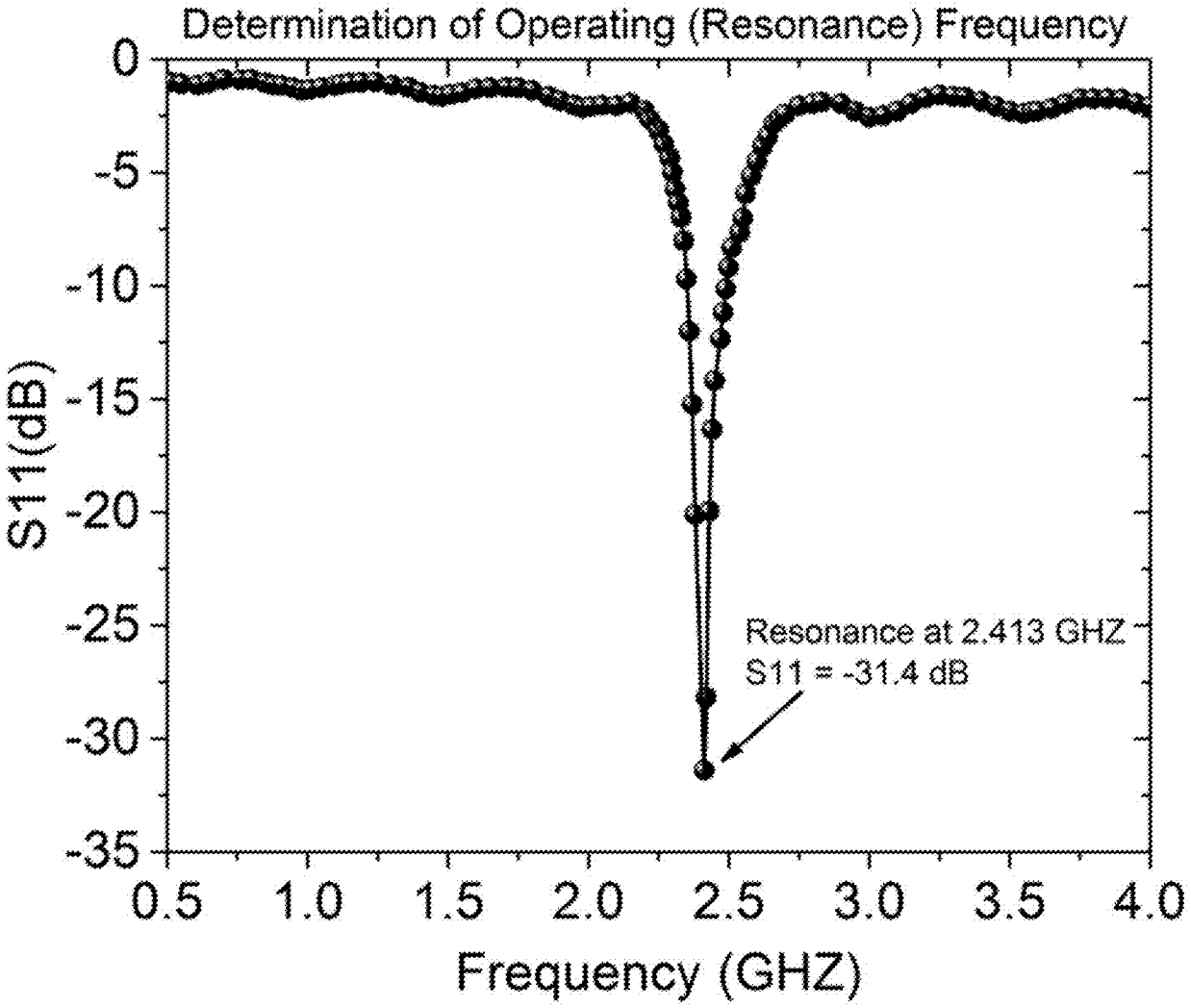
FIG. 5B presents the results of a test to determine the operating frequency of the antenna depicted in FIG. 5A.

The antenna 10 depicted in FIG. 5A, may be designed with a commercial CAD package that is compatible with 3D-printers, e.g. Stratasys Fortus 450mc. The parts may be made of ULTEM 1010. After manually removing the support material, the parts 12, 14 may be subjected to a 2-hour surface finishing process, e.g. using a LEVO finisher from the company POSTPROCESS. Residual abrasive material from the finishing process may be cleaned by ultrasonication in an aqueous bath with 10% Branson detergent for about 15 minutes, followed by rinsing in clean water and then isopropanol before blow drying the parts with nitrogen. Of course, the particular equipment, software, and materials will vary depending upon the time requirements (manufacturing urgency) and performance characteristics (operating frequency) of the finished antenna.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method for making an antenna comprising:

creating a digital antenna file defining dimensional characteristics of a radiating support structure disk and a ground support structure disk;

uploading the digital antenna file to an additive-manufacturing device;

manufacturing the radiating support structure disk and ground support structure disk with the additive-manufacturing device;

coating one entire side of both the radiating support structure disk and ground support structure disk with a conductive ink;

attaching the radiating support structure disk and ground support structure disk together;

fixing a radio frequency connector to the conductive ink on the radiating support structure disk and the ground support structure disk.

2. The method for making an antenna of claim 1, wherein the dimensional characteristics of the radiating support structure disk and the ground support structure disk correspond to the operating frequency of the antenna.

3. The method for making an antenna of claim 1, wherein the radiating support structure disk and the ground support structure disk are attached together with a dielectric adhesive.

4. The method for making an antenna of claim 1, wherein the radio frequency connector is a coaxial cable where its center conductor is connected to the conductive coating of the radiating support structure disk and its outer conductor is connected to the conductive coating of the ground support structure disk using a conductive adhesive.

* * * * *